US008444784B2

(12) United States Patent
Daoud et al.

(10) Patent No.: US 8,444,784 B2
(45) Date of Patent: May 21, 2013

(54) INSENSITIVE MUNITION-TYPE BNCP EXPLOSIVE MATERIAL AND METHODS FOR FORMING THE SAME

(75) Inventors: Sami Daoud, New Hope, PA (US); Thomas R. Berger, Tucson, AZ (US); Michael J. Villeburn, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 742 days.

(21) Appl. No.: 12/636,935

(22) Filed: Dec. 14, 2009

(65) Prior Publication Data

US 2012/0180914 A1 Jul. 19, 2012

(51) Int. Cl.

| | |
|---|---|
| ***C06B 45/00*** | (2006.01) |
| ***C06B 29/00*** | (2006.01) |
| ***C06B 25/00*** | (2006.01) |
| ***C06B 25/34*** | (2006.01) |
| ***C06B 25/04*** | (2006.01) |
| ***D03D 23/00*** | (2006.01) |
| ***D03D 43/00*** | (2006.01) |

(52) U.S. Cl.
USPC ..... 149/2; 149/75; 149/88; 149/92; 149/105; 149/108.8

(58) Field of Classification Search ..... 149/2, 75, 149/88, 92, 105, 108.8
See application file for complete search history.

(56) References Cited

U.S. PATENT DOCUMENTS

| | | | | |
|---|---|---|---|---|
| 4,093,623 | A * | 6/1978 | Gilligan et al. | 548/109 |
| 4,094,879 | A * | 6/1978 | Bates et al. | 548/109 |
| 4,270,455 | A * | 6/1981 | Janoski | 102/318 |
| 4,552,598 | A * | 11/1985 | Lee et al. | 149/47 |
| 5,831,203 | A * | 11/1998 | Ewick | 102/202.5 |
| 5,929,368 | A | 7/1999 | Ewick et al. | |
| 6,408,759 | B1 | 6/2002 | Ewick et al. | |
| 6,761,116 | B2 | 7/2004 | Daoud | |
| 7,253,288 | B2 | 8/2007 | Renz et al. | |
| 2009/0044885 | A1 | 2/2009 | Brisighella et al. | |
| 2009/0044886 | A1 | 2/2009 | Brisighella et al. | |

OTHER PUBLICATIONS

Talawar, M.B., et al. "Energetic co-ordination compounds: synthesis, characterization and thermolysis studies on bis-(5-nitro-2H-tetrazolato-N2) tetramine cobalt(III) perchlorate (BNCP) and its new transition metal (Ni/Cu/Zn) Perchlorate analogues"; Journal of Hazardous Materials, A120 (2005), p. 25-35.

Merson, John A. et al. "The Development of Laser Ignited Deflagration-To-Detonation Transition (DDT) Detonators and Pyrotechnic Actuators"; 1994 Joint USA-Russia Energetic Material Technology Symposium; Livermore, California, May 18-25, 1994.

* cited by examiner

*Primary Examiner* — James McDonough
(74) *Attorney, Agent, or Firm* — Cantor Colburn LLP

(57) ABSTRACT

Insensitive munition-type explosive material and methods for forming insensitive munition-type explosive material are provided. In an exemplary embodiment, an insensitive munition-type explosive material comprises a particle of BNCP and a surfactant-comprising shell that encapsulates the particle of BNCP.

12 Claims, 3 Drawing Sheets

INSENSITIVE MUNITION-TYPE BNCP EXPLOSIVE MATERIAL AND METHODS FOR FORMING THE SAME

FIELD OF THE INVENTION

The present invention generally relates to explosive compositions and methods for fabricating explosive compositions and, more particularly, relates to insensitive munition-type BNCP explosive material and methods for synthesizing insensitive munition-type BNCP explosive material.

BACKGROUND OF THE INVENTION

Historically, azide-based primary explosives, namely lead azide and lead styphnate, were utilized in electroexplosive devices and mechanically-actuated devices as viable primary explosives, replacing toxic lead picrate and mercury fulminate, which had unpredictable shelf-lives. Over the years, however, extensive and long-term use of lead azide and lead styphnate in primary explosives has resulted in significant lead contamination of artillery and firing ranges, and has caused major health hazards and environmental problems for both military and civilian personnel.

Bis, nitro cobalt (III) perchlorate, or using the IUPAC convention, cis-bis-(5-nitrotetrazolato)tetramine cobalt (III) perchlorate (hereinafter "BNCP"), is a primary explosive that does not contain lead and thus has become an alternative to the lead-comprising explosives. BNCP undergoes deflagration-detonation transition (DDT) in very short distances and maintains energetic properties similar to lead azide and lead styphnate upon exposure to the atmosphere. In addition, BNCP is insensitive to light, is thermally stable to at least 200° C., is chemically stable for extended periods, and is absent of any and all lead-based-type toxic metals, such as mercury, silver, barium, and antimony. However, conventional BNCP is sensitive to handling and transportation, which renders it susceptible to sympathetic detonation as a result of mechanical shocks, fire, electrostatic discharge, and impact by shrapnel. A desirable BNCP explosive material would conform to "insensitive munition" (IM) properties, that is, properties that would render it capable of withstanding sympathetic detonation as a result of mechanical shocks, fire, electrostatic discharge, and impact by shrapnel, yet still be capable of high-order detonation per design intent.

Accordingly, it is desirable to provide an insensitive munition-type BNCP explosive material. In addition, it is desirable to methods for synthesizing insensitive munition-type BNCP explosive material. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

Insensitive munition-type explosive material and methods for forming insensitive munition-type explosive material are provided. In an exemplary embodiment, an insensitive munition-type explosive material comprises a particle of BNCP and a surfactant-comprising shell that encapsulates the particle of BNCP.

In accordance with an exemplary embodiment, a method for forming an insensitive munition-type BNCP explosive material comprises combining NaNT, CTCN, and perchloric acid to form a mixture, forming a BNCP precipitate from the mixture, collecting the BNCP precipitate, and forming an insensitive munition-type BNCP in an emulsion from the BNCP precipitate and a surfactant.

In accordance with another exemplary embodiment, a method for forming an insensitive munition-type BNCP explosive material comprises dispersing BNCP and a surfactant in a liquid phase to form an emulsion comprising IM BNCP, filtering the emulsion to collect the IM BNCP, and drying the IM BNCP.

BRIEF DESCRIPTION OF THE DRAWINGS

The present invention will hereinafter be described in conjunction with the following drawing figures, wherein like numerals denote like elements, and wherein.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The various embodiments contemplated herein relate to BNCP explosive material that exhibits improved IM properties compared to conventional BNCP. In particular, various embodiments contemplated herein are directed to an insensitive munition-type explosive material comprising a particle of BNCP encapsulated by a surface active agent or "surfactant". The surfactant serves as a protective/desensitizing shell that protects the BNCP particle from mechanical shocks, fire, electrostatic discharge, and impact by shrapnel that would otherwise result in sympathetic detonation of the BNCP. Despite the presence of the surfactant shell, however, the BNCP particle is still capable of high-order detonation per design intent.

Figure 1:
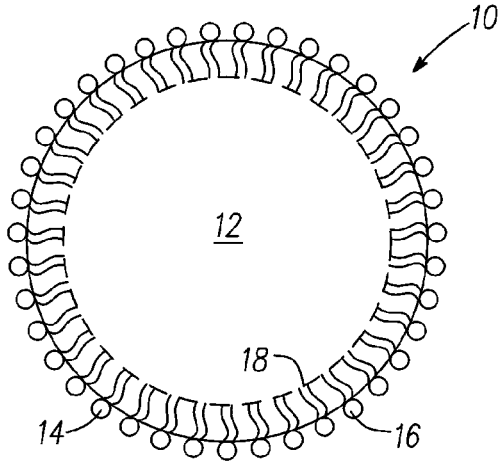
FIG. 1 is a schematic cross-sectional view of an insensitive munition (IM) BNCP particle, in accordance with an exemplary embodiment of the present invention.
Figure 2:
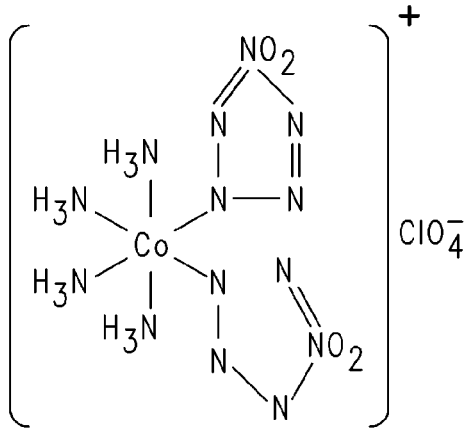
FIG. 2 is a schematic illustration of a molecular structure of BNCP.

Referring to FIG. 1, in one exemplary embodiment of the present invention, insensitive munition-type BNCP 10 (hereinafter "IM BNCP") comprises a particle 12 of BNCP. While only one particle 12 is shown for illustration purposes, it will be understood that IM BNCP 10 suitable for use as explosive material will comprise many particles 12. BNCP is a coordination compound related to pentammine (5-cyano-2H-tetrazolato-$N^2$) cobalt (III) perchlorate or "CP" and has the structure illustrated in FIG. 2. BNCP is synthesized by the anation reaction of sodium nitrotetrazol ($NaTzNO_2.2H_2O$) and tretramine carbonato cobalt (III) nitrate (CTCN). The BNCP particle 12 is encapsulated by one or more surfactants 14, which form a shell-like structure around the particle 12. The shell-like structure is effectively an electric double layer with a hydrophilic part or "head" 16 of the surfactant forming an outside surface of the shell-like structure and a hydrophobic part or "tail" 18 of the surfactant coupled to the BNCP particle.

Surfactants 14 suitable for use in the IM BNCP include anionic, nonionic, cationic, and amphoteric surfactants, and combinations thereof. Any surfactant that can be added to a selected liquid phase to lower the surface tension of the selected liquid phase sufficiently so that BNCP particles 12 can form a colloidal dispersion, i.e., an emulsion, with the selected liquid phase can be used. For example, if water is the selected liquid phase, sodium laurel sulfate can be used as a surfactant to suspend BNCP particles in the water, thus forming a colloidal dispersion or an emulsion. Examples of anionic surfactants suitable for use in the exemplary embodiments of the IM BNCP contemplated herein include ammonium dodecyl sulfate, sodium lauryl sulfate, perfluorobutanesulfonic acid, sodium bis(2-ethylhexyl) sulfosuccinate, sodium lauroyl sarcosinate, sodium tallowate, and the like.

Examples of nonionic surfactants suitable for use include polyoxy-ethylene alcohols, alkyl phenol ethoxylates, sorbitan monopalmitate, methyltrialkyl($C_8$-$C_{10}$)ammonium chlorides, such as Adogen® 464 manufactured by Sherex Chemical Company of Mapleton, Ill., the Brij® class of nonionic surfactants, including, but not limited to, Brij® 30, Brij® 52, Brij® 56, Brij® 58, Brij® 72, Brij® 78, and Brij®92V (the Brij® class manufactured by Croda International, United Kingdom), Alkonal® from E.I. du Pont de Nemours & Company, Wilmington, Del., the Igepal® class of nonionic surfactants, including, but not limited to, Igepal® CA-210, Igepal® CA-520, Igepal® CA-720, Igepal® CO-210, Igepal® CO-520, Igepal® CO-630, and Igepal® CO-720 (the Igepal® class manufactured by Rhodia Novecare of Cranbury, N.J.), the Merpol® class of nonionic surfactants, including, but not limited to, Merpol® A, Merpol® DA, Merpol® OJ, Merpol® SE, and Merpol® SH (the Merpol® class manufactured by Stepan Company of Northfield, Ill.), Triton®N-101 and Triton® X-114 manufactured by Dow Chemical Company of Midland, Mich., Tween® 20 manufactured by Roche Applied Science of Germany, and the Zonyl® class of nonionic surfactants, including, but not limited to, Zonyl® FS-300, Zonyl® FSA, Zonyl® FSE, Zonyl® FSJ, Zonyl® FSK, Zonyl® FSN, and Zonyl® FSO (the Zonyl® class manufactured by E.I. du Pont de Nemours & Company, Wilmington, Del.).

Examples of cationic surfactants suitable for use in the exemplary embodiments contemplated herein include quaternary ammonium salts. Amphoteric surfactants also suitable for use herein include long chain ethers, fatty acid esters, amides, and carboxybetaines.

Figure 3:
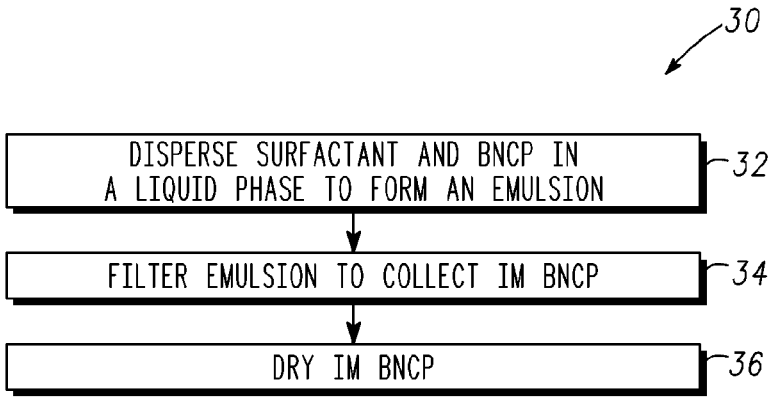
FIG. 3 is a flowchart of a method for forming IM BNCP, in accordance with an exemplary embodiment of the present invention.

A method 30 of forming an IM BNCP, in accordance with an exemplary embodiment, is illustrated in FIG. 3. The method begins by dispersing at least one surfactant in a liquid phase followed by dispersion of BNCP in that low-surface tension surfactant-containing liquid phase to form a colloidal dispersion or an emulsion (step 32). Suitable liquid phases include, for example, water, deionized water, isopropyl alcohol, glycols, e.g., polyethylene and polypropylene glycols, ethyl alcohol, diacetone alcohol, and the like. In a preferred embodiment, the liquid phase comprises isopropyl alcohol. As noted above, any surfactant that can be added to the selected liquid phase to lower the surface tension of the selected liquid phase sufficiently so that the BNCP can be suspended in the selected liquid phase can be used. To facilitate formation of the emulsion, in one exemplary embodiment, the surfactant is added to the selected liquid phase while the selected liquid phase is vigorously mixed, such as by vigorous stirring, shaking, agitating, or fluid energy milling (FEM), to achieve homogenization. In yet another embodiment, the surfactant/selected liquid phase mixture is vigorously stirred while the BNCP or a precursor of BNCP, as discussed in more detail below, is dispersed and the stirring may continue until a colloidal dispersion or an emulsion is achieved. A sufficient amount of surfactant is added so that the critical micelle concentration (CMC) is substantially approached in the emulsion but is not substantially exceeded. CMC is the concentration of the surfactant(s) micelles above which those micelles spontaneously begin to form. In one embodiment, the surfactant concentration is within about ±1% of the CMC. Below this concentration, the solution has a lower surface tension than desired and the BNCP is not sufficiently encapsulated by the surfactant so as to achieve optimum IM properties, i.e., BNCP particles precipitate out of solution and the emulsion breaks down. Above this concentration, detergency and, hence, foaming results.

In one optional embodiment (not shown), the resulting emulsion can be used for the ignition of liquid propellants, such as, for example, ignition of hydroxylammonium nitrate (HAN) liquid propellant. In another optional embodiment, the resulting emulsion is filtered, such as by vacuum-filtration, to collect the IM BNCP from the remaining mixture (step 34). The IM BNCP then can be air-dried and/or oven-dried (step 36) and packaged or tested as desired. Because the BNCP is insensitive, it imparts characteristics that make it attractive for use not only as an ignition material, but also as a very high output IM explosive for warheads.

Figure 4:
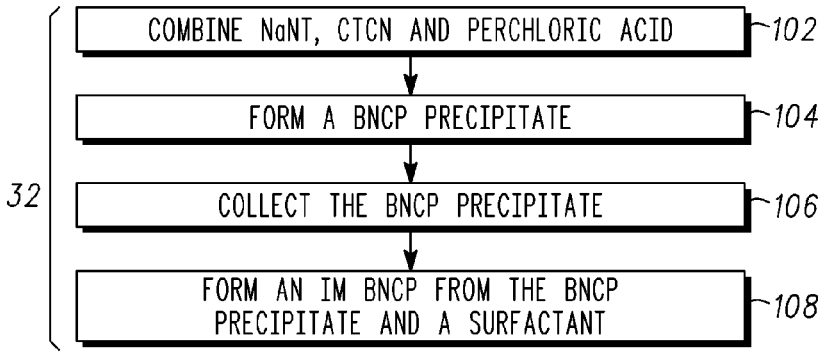
FIG. 4 is a method for performing step 32 of the method of FIG. 3, in accordance with an exemplary embodiment of the present invention.

In one exemplary embodiment, the step 32 of dispersing the surfactant followed by the dispersion of the BNCP in a liquid phase includes pre-forming BNCP and then dispersing the pre-formed BNCP and a surfactant in the liquid phase to form IM BNCP. Referring to FIG. 4, in this step 32, otherwise referred to as a "non-colloidal" approach, precursors of BNCP, that is, sodium nitrotetrazol (NaNT), carbonato tetramine cobalt (III) nitrate (CTCN), and perchloric acid ($HClO_4$) are combined (step 102) and a BNCP precipitate is formed (step 104). The BNCP precipitate is collected (step 106), such as by vacuum filtration, and IM BNCP is formed from the collected BNCP precipitate and a surfactant (step 108).

In a preferred exemplary embodiment, the step of forming a BNCP precipitate (step 104) comprises forming subsequently smaller diameter micron sizes of BNCP particles before fine BNCP particles are encapsulated by the surfactant. As noted above, BNCP is an ignition material that undergoes deflagration-detonation transition (DDT). The smaller the particle size of the BNCP, the higher the surface area of the BNCP and the more efficient the DDT process is. Additionally, time to ignition and time to achieve maximum pressure of an igniter must be reproducible, must be accurate, and must occur very rapidly; this is achieved when the mass burning rate of the ignition material is markedly quick. Particle size of the ignition material controls relative quickness (Rq) to DDT of the ignition material and, thus, small particle diameter size is preferred. In this preferred method, illustrated in FIG. 5, after the combination of NaNT, CTCN, and perchloric acid (step 102 of FIG. 4), a crude BNCP precipitate is formed (step 110). This crude BNCP precipitate has particle diameter sizes in the range of from about 25 to about 100 microns (μm). From this crude BNCP precipitate, a recrystallized BNCP precipitate is formed (step 112). This recrystallized BNCP precipitate has particle diameter sizes in the range of from about 8 to about 25 μm. From this recrystallized BNCP precipitate, the fine BNCP precipitate is formed (step 114). The fine BNCP has particle diameter sizes in the range of from about 20 nanometers (nm) to about 8 μm. Once the fine BNCP precipitate is formed, step 106 of FIG. 4 may continue with the collection of the fine BNCP precipitate.

Figure 5:
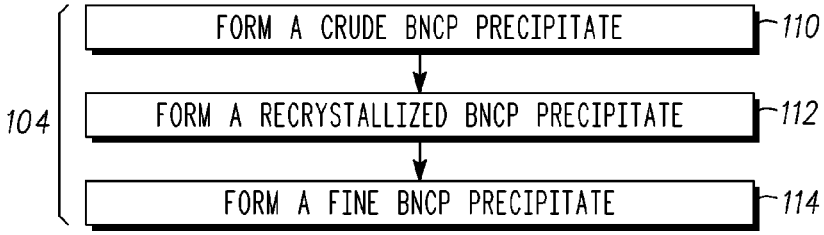
FIG. 5 is a method for forming step 104 of the method of FIG. 4, in accordance with an exemplary embodiment of the present invention.
Figure 6:
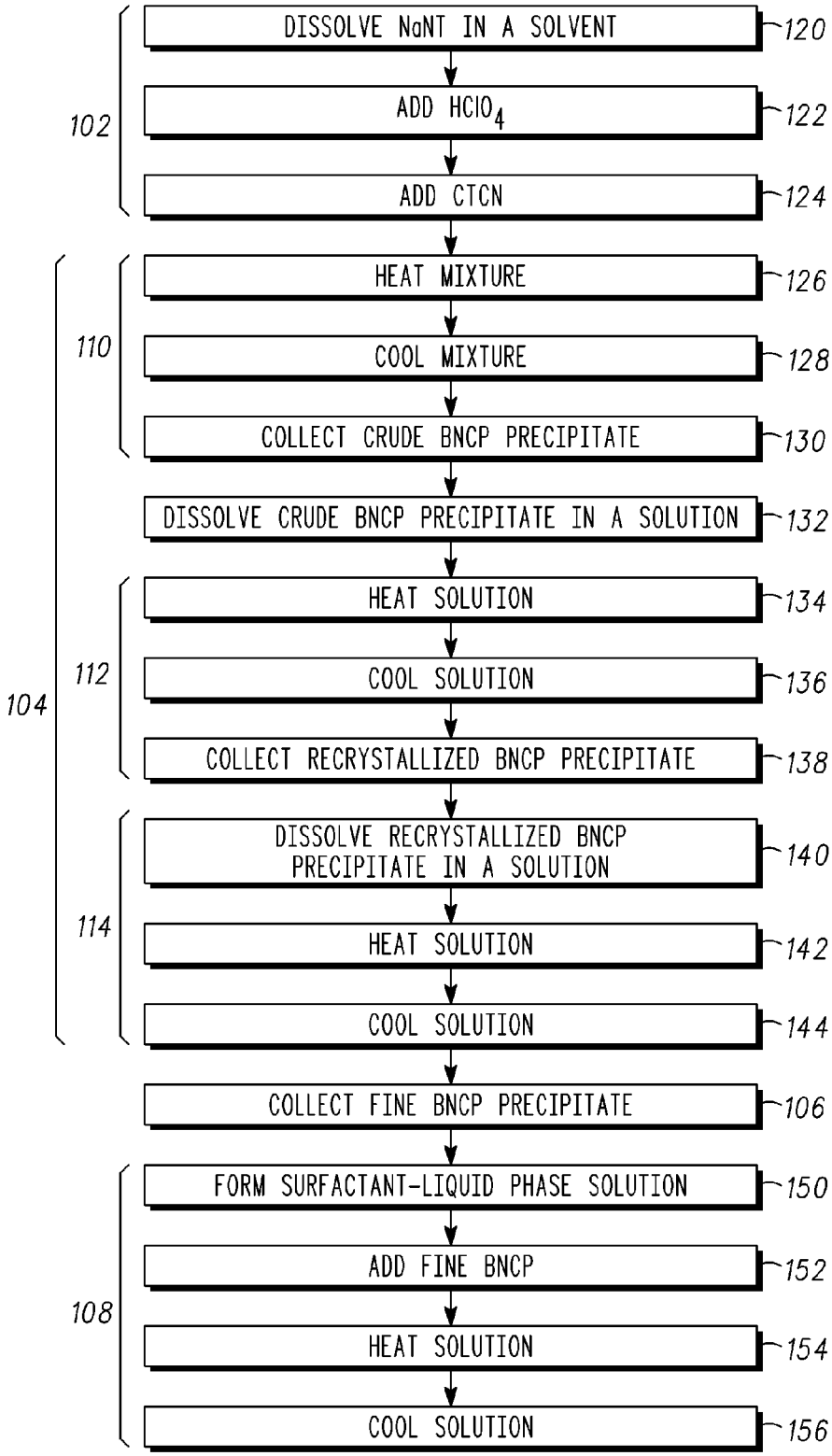
FIG. 6 is a method for forming step 102, 106, and 108 of the method of FIG. 4 and step 104 of the method of FIG. 5, in accordance with an exemplary embodiment of the present invention.

A more preferred embodiment of steps 102, 104, 106, and 108 of FIGS. 4 and 5 are illustrated in FIG. 6. In this regard, step 102 begins by dissolving NaNT in a solvent (step 120). The solvent may be any solvent suitable for dissolving both NaNT and CTCN. Examples of suitable solvents include de-ionized water, ethyl alcohol, propyl alcohol, diacetone alcohol, or the like. Perchloric acid is added to the solvent until the pH is about 2-3 (step 122). While stirring, CTCN is added to the perchloric acid/NaNT solution (step 124) and, if necessary, perchloric acid is then again added to return the pH of the solution to about 2-3. Forming a BNCP precipitate (step 104 of FIG. 4) then includes heating the mixture, with continued stirring, to about 82° C. (about 180° F.) to about 99° C. (210° F.), preferably about 91° C. (195° F.) while the pH is maintained at about 2-3 (step 126). The temperature is maintained at about 82° C. (about 180° F.) to about 99° C. (210° F.), preferably at about 91° C. (195° F.), for about 1-4 hours, preferably about 2-3 hours, more preferably about 2.5 hours, while the pH is maintained at about 2-3. Next, the solution is cooled to about 37° C. (100° F.) to about 60° C. (140° F.), preferably about 49° C. (120° F.), and then chilled to about −3.8° C. (25° F.) to about 1.7° C. (35° F.), preferably about 0.6° C. (31° F.) for about 30 minutes to about 2 hours, preferably about 1 hour (step 128) during which time a crude BNCP precipitate forms (step 110 of FIG. 5). The crude BNCP precipitate is then collected from the solution, such as by vacuum filtration, (step 130). The crude BNCP filtrate then can be washed with de-ionized water and/or isopropyl alcohol and allowed to air dry. As noted above, particles of the crude BNCP will have diameter sizes in the range of from about 25 to about 100 μm Next, recrystallization of the crude BNCP is performed to produce a distribution of smaller size BNCP particles (step 112 of FIG. 5). In this regard, referring again to FIG. 6, crude BNCP is dissolved in a perchloric acid solution (step 132). The solution is heated to a temperature in the range of about 82° C. (about 180° F.) to about 99° C. (210° F.), preferably about 91° C. (195° F.) (step 134) and the solution is stirred until the crude BNCP is completely dissolved and the solution is clear. The solution is removed from the heat and allowed to cool to about 37° C. (100° F.) to about 60° C. (140° F.), preferably about 49° C. (120° F.), during stirring and then is chilled, while stirring continues, to about −3.8° C. (25° F.) to about 1.7° C. (35° F.), preferably about 0.6° C. (31° F.) for about 30 minutes to about 2 hours, preferably about 1 hour (step 136) during which time a recrystallized BNCP precipitate forms. The recrystallized BNCP precipitate is collected from the solution, such as by vacuum filtration, (step 138). The recrystallized BNCP filtrate then can be washed, such as with isopropyl alcohol, acetone, tetrahydrofuran, or the like, and allowed to air dry. As noted above, particles of the recrystallized BNCP have particle diameter sizes in the range of about 8 to about 25 μm.

Fine BNCP then is formed to achieve BNCP particles having a particle diameter size in the range of about 20 nm to about 8 μm (step 114 of FIG. 5). Referring again to FIG. 6, the recrystallized BNCP is dissolved in a perchloric acid solution (step 140) and, while stirring, the solution is heated to a temperature in the range of about 82° C. (about 180° F.) to about 99° C. (210° F.), preferably about 91° C. (195° F.) (step 142), until the recrystallized BNCP is completely dissolved and the solution is clear. The solution is removed from the heat and allowed to cool during stirring to about 37° C. (100° F.) to about 60° C. (140° F.), preferably about 49° C. (120° F.) and then is chilled to about −3.8° C. (25° F.) to about 1.7° C. (35° F.), preferably about 0.6° C. (31° F.) for about 30 minutes to about 2 hours, preferably about 1 hour (step 144). A bright yellow precipitate of fine BNCP forms. The fine BNCP precipitate is collected, such as by vacuum filtration (step 106) and the method then may continue with the formation of IM BNCP (step 108).

In one exemplary embodiment, the step of forming IM BNCP (step 108) begins by creating a low surface tension medium with the formation of a surfactant-liquid phase solution (step 150). In this regard, a liquid phase, such as for example, isopropyl alcohol, deionized water, polyethylene glycol, polypropylene glycol, or the like, and a suitable surfactant are combined using vigorous mixing, such as vigorous stirring, shaking, agitation, FEM, etc., for homogenization. In a preferred embodiment, the liquid phase is cooled to a temperature in the range of about 1.7° C. (35° F.) to about 18.3° C. (65° F.), preferably about 10° C. (50° F.), before the surfactant is added. Once the surfactant is completely dispersed in the solution phase, the stirring is slowed and the fine BNCP is slowly added to the solution (step 152). When all of the fine BNCP is added, the solution is heated to a temperature in the range of 71° C. (160° F.) to about 88° C. (190° F.), preferably about 79° C. (175° F.), while vigorous stirring is again performed (step 154). Stirring is continued for about 15 seconds to about a minute, preferably about 30 seconds, and then the solution is cooled to about −3.8° C. (25° F.) to about 1.7° C. (35° F.), preferably about 0.6° C. (31° F.) (step 156). After the completion of step 108 of FIG. 6, and hence step 32 of FIG. 3, method 30 of FIG. 3 continues with the filtration of the solution to collect IM BNCP (step 34) and the drying of the IM BNCP, such as by air and/or oven drying (step 36).

Figure 7:
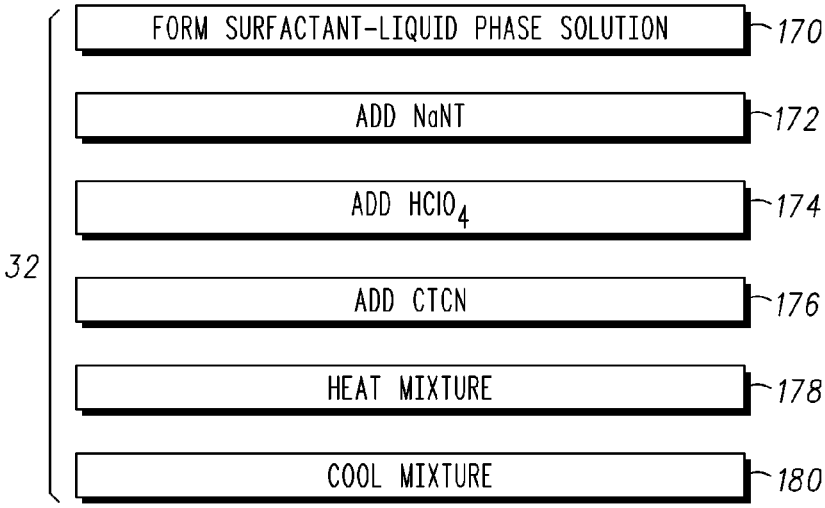
FIG. 7 is a method for performing step 32 of the method of FIG. 3, in accordance with another exemplary embodiment of the present invention.

In an alternative exemplary embodiment to those depicted in FIGS. 4-6, the step of dispersing the BNCP and the surfactant in a liquid phase (step 32 of FIG. 3) includes forming a surfactant-liquid phase solution and forming the BNCP in the surfactant-liquid phase solution. In this approach, otherwise referred to as a "colloidal" approach, the precursors of BNCP, rather than pre-formed BNCP, are added to a surfactant-liquid phase solution to form an IM BNCP emulsion, the IM BNCP having a particle diameter sizes in the range of about 20 nm to about 8 μm. In this regard, referring to FIG. 7, a low surface tension medium is created by forming a surfactant-liquid phase solution (step 170). The liquid phase, such as for example, isopropyl alcohol, deionized water, ethyl alcohol, diacetone alcohol, or the like, and a suitable surfactant are combined using vigorous mixing, such as vigorous stirring, shaking, agitation, FEM, etc. During vigorous mixing, NaNT is added to the solution and the resulting emulsion is homogenized (step 172). Perchloric acid is added to the emulsion until the emulsion achieves a pH of about 2-3 (step 174) and CTCN is added while vigorous mixing continues (step 176). In one exemplary embodiment, perchloric acid is again added to the emulsion to return the emulsion to a pH of about 2-3.

Next, the emulsion is heated to an elevated temperature in the range of 71° C. (160° F.) to about 88° C. (190° F.), preferably about 79° C. (175° F.), while moderate stirring is performed (step 178). The emulsion can be maintained at a pH of about 2-3 with the addition of perchloric acid as needed. The elevated temperature is maintained for about 15 minutes to about an hour, preferably about 30 minutes. The emulsion is cooled to about 40° C. (105° F.) to about 57° C. (135° F.), preferably about 49° C. (120° F.) and then is chilled to about −7° C. (18° F.) to about −2° C. (28° F.), preferably about −5° C. (23° F.) (step 180). The emulsion can be chilled by placing a beaker or other vessel of the emulsion in an ice bath or by pouring the emulsion into a chilled liquid, such as, for example, isopropyl alcohol. The emulsion is chilled for about from thirty minutes to about 2 hours, preferably about one hour, at which time IM BNCP precipitate forms. Referring back to FIG. 3, the method 30 continues with the filtration of the emulsion (step 34) and the drying of the IM BNCP (step 36), as described above.

The following are exemplary embodiments of methods for forming IM BNCP as contemplated herein. The examples are provided for illustration purposes only and are not meant to limit the various embodiments of the methods in any way.

EXAMPLE 1

Non-Colloidal Approach

In a 250 milliliter (ml) beaker, 16.8 grams (g) of NaNT was dissolved in 100 ml deionized water. To the solution, about 0.1 g of 70% perchloric acid was added until the pH of the solution was about 2 to about 3. The solution was stirred and, during stirring, 10 g of CTCN was added to the solution. 70% perchloric acid was added drop-wise to the solution until the pH of the solution returned to 2 to about 3. During this procedure, $CO_2$ gas evolved. Stirring was continued and the solution was heated to about 90.5° C. (195° F.) while the pH was maintained at about 2-3 by the addition of perchloric acid as needed. The solution temperature was maintained at 90.5° C. (195° F.) and a pH of about 2-3 for about 2.5 hours. The solution was cooled to about 48.8° C. (120° F.) and the beaker was placed in an ice bath to cool the solution to −0.5° C. (31° F.). The solution remained at this temperature for one hour during which a crude BNCP precipitate formed. Vacuum filtration was performed to remove the crude BNCP precipitate from the emulsion and the precipitate particles were washed with cold de-ionized water. The precipitate was then washed with isopropyl alcohol and air dried.

In a 2000 ml beaker, 2 ml of 70% perchloric acid was added to 1000 ml de-ionized water to produce a 0.2% perchloric acid solution. For each 20 ml of the 0.2% perchloric acid solution, one gram of the crude BNCP precipitate was dissolved therein. The solution was heated to about 90.5° C. (195° F.) and stirred until the crude BNCP was substantially completely dissolved and the solution was clear. The solution was removed from the heat and cooled to about 48.8° C. (120° F.) with stirring. The solution then was chilled to −0.5° C. (31° F.). The solution remained at this temperature for one hour during which a recrystallized BNCP precipitate formed. Vacuum filtration was performed to remove the recrystallized BNCP precipitate from the emulsion and the precipitate particles were washed with isopropyl alcohol and air dried.

The recrystallized BNCP was dissolved in 0.2% perchloric acid solution in a ratio of 1 g recrystallized BNCP per 20 ml 0.2% perchloric acid solution. The solution was heated to about 90.5° C. (195° F.) and was stirred until the recrystallized BNCP was substantially completely dissolved and the solution was clear. The solution was removed from the heat and cooled to about 48.8° C. (120° F.) with stirring. Isopropyl alcohol, in the amount of seven times the volume of the 0.2% perchloric acid in the solution, was chilled to −0.5° C. (31° F.). Once the cooled BNCP solution was clear, it was poured slowly into the chilled isopropyl alcohol and remained at this temperature for one hour during which a bright yellow fine BNCP precipitate formed. Vacuum filtration was performed to remove the fine BNCP precipitate from the solution. The precipitate was then washed with isopropyl alcohol and air dried.

In a 1000 ml beaker containing 500 ml of isopropyl alcohol, 0.05 g of Triton® N-101 was added while stirring at low speed was performed. The temperature was slowly raised to 60° C. (140° F.). 10 g of fine BNCP was slowly added while the emulsion was homogenizing. Once all of the fine BNCP was added, the temperature of the emulsion was raised to 79.4° C. (175° F.) and homogenization was continued for 5 minutes. The dispersion then was chilled to −0.5° C. (31° F.) using an ice bath. Vacuum filtration was performed to remove the IM BNCP from the emulsion. The IM BNCP was then washed with isopropyl alcohol and air dried.

EXAMPLE 2

Colloidal Approach

In a 500 milliliter (ml) beaker, 0.35 g of Triton® N-101 was dissolved in water. To the low surface tension water, 16.8 g NaNT was added while vigorous stirring was performed. 0.1 g 70% perchloric acid was added to the solution until the pH was about 2 to about 3. While vigorously stirring, 10 g CTCN was added to the solution, which raised the pH of the solution. Stirring was slowed and 70% perchloric acid was again added dropwise until the pH returned to about 2 to about 3, during which time $CO_2$ evolved. Moderate stirring was continued and the solution was heated to about 79.4° C. (175° F.) while the pH was maintained at about 2-3 by the addition of perchloric acid as needed. The solution temperature was maintained at 79.4° C. (175° F.) and a pH of about 2-3 for about 0.5 hours. The solution was cooled to about 48.8° C. (120° F.) and the beaker was placed in an ice bath to cool the solution to −5° C. (23° F.). The solution remained at this temperature for one hour during which an IM BNCP precipitate formed. Vacuum filtration was performed to remove the IM BNCP precipitate from the emulsion and the precipitate particles were washed with isopropyl alcohol and air dried.

Accordingly, various embodiments of insensitive munition-type BNCP explosive material have been provided herein. The IM BNCP particles comprise a particle of BNCP encapsulated by a surface active agent or "surfactant". The surfactant serves as a protective shell that protects the BNCP particle from mechanical shocks, fire, electrostatic discharge, and impact by shrapnel that would otherwise result in sympathetic detonation of the BNCP. Despite the presence of the surfactant shell, the BNCP particle is still capable of high-order detonation per design intent. The IM BNCP particle can be formed by colloidal or non-colloidal approaches, both of which achieve IM BNCP particles having particle diameter sizes in the range of 20 nm to about 8 μm.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A method for forming an insensitive munition-type BNCP explosive material, the method comprising the steps of:

combining NaNT, CTCN, and perchloric acid to form a mixture;

forming a BNCP precipitate from the mixture;

collecting the BNCP precipitate;

forming an insensitive munition-type BNCP in an emulsion from the BNCP precipitate and a surfactant;

filtering the emulsion to collect the insensitive munition-type BNCP; and drying the insensitive munition-type BNCP.

2. A method for forming an insensitive munition-type BNCP explosive material, the method comprising the steps of:

combining NaNT, CTCN, and perchloric acid to form a mixture;

forming a BNCP precipitate from the mixture;

collecting the BNCP precipitate;

forming an insensitive munition-type BNCP in an emulsion from the BNCP precipitate and a surfactant; and using the insensitive munition-type BNCP in the emulsion for ignition of a liquid propellant.

3. The method of claim 1, wherein the step of combining NaNT, CTCN, and perchloric acid comprises the steps of:

dissolving NaNT in a solvent;

adding perchloric acid to form a NaNT/perchloric acid solution; and adding CTCN to the NaNT/perchloric acid solution to form a CTCN/NaNT/perchloric acid solution.

4. The method of claim 3, further comprising adding additional perchloric acid to the CTCN/NaNT/perchloric acid solution.

5. A method for forming an insensitive munition-type BNCP explosive material, the method comprising the steps of:

combining NaNT, CTCN, and perchloric acid to form a mixture;

forming a BNCP precipitate from the mixture;

collecting the BNCP precipitate; and forming an insensitive munition-type BNCP in an emulsion from the BNCP precipitate and a surfactant; and wherein the step of forming the BNCP precipitate comprises the steps of:

forming a crude BNCP precipitate;

forming a recrystallized BNCP precipitate from the crude BNCP precipitate; and forming a fine BNCP precipitate from the recrystallized BNCP precipitate.

6. The method of claim 5, wherein the step of forming a crude BNCP precipitate comprises the steps of:

heating the mixture;

cooling the mixture; and collecting the crude BNCP precipitate.

7. The method of claim 5, wherein the step of forming a recrystallized BNCP precipitate comprises the steps of:

dissolving the crude BNCP precipitate in a perchloric acid solution;

heating the perchloric acid solution;

cooling the perchloric acid solution; and collecting the recrystallized BNCP precipitate.

8. The method of claim 5, wherein the step of forming a fine BNCP precipitate comprises the steps of:

dissolving the recrystallized BNCP precipitate in a perchloric acid solution;

heating the perchloric acid solution; and cooling the perchloric acid solution.

9. The method of claim 8, wherein the step of collecting the BNCP precipitate comprises collecting the fine BNCP precipitate.

10. A method for forming an insensitive munition-type BNCP explosive material, the method comprising the steps of:

combining NaNT, CTCN, and perchloric acid to form a mixture;

forming a BNCP precipitate from the mixture;

collecting the BNCP precipitate; and forming an insensitive munition-type BNCP in an emulsion from the BNCP precipitate and a surfactant; wherein the step of forming an insensitive munition-type BNCP in an emulsion from the BNCP precipitate and a surfactant comprises:

forming a surfactant-liquid phase solution;

adding the BNCP precipitate to the surfactant-liquid phase solution;

heating the surfactant-liquid phase solution; and cooling the surfactant-liquid phase solution.

11. The method of claim 1, wherein the step of forming an insensitive munition-type BNCP in an emulsion from the BNCP precipitate and a surfactant comprises forming an insensitive munition-type BNCP in an emulsion from the BNCP precipitate and a nonionic surfactant, an anionic surfactant, a cationic surfactant, an amphoteric surfactant, or a combination thereof.

12. A method for forming an insensitive munition-type BNCP explosive material, the method comprising the steps of:

combining NaNT, CTCN, and perchloric acid to form a mixture;

forming a BNCP precipitate from the mixture;

collecting the BNCP precipitate; and forming an insensitive munition-type BNCP in an emulsion from the BNCP precipitate and a surfactant; wherein the step of forming an insensitive munition-type BNCP comprises forming an insensitive munition-type BNCP having a particle diameter size in the range of from about 20 nm to about 8 microns.

* * * * *